United States Patent [19]

Picchione

[11] 4,216,547

[45] Aug. 12, 1980

[54] INJURY PROTECTION DEVICE FOR ATHLETES

[76] Inventor: P. Vincent Picchione, 968 Avenida Olivos, Palm Springs, Calif. 92262

[21] Appl. No.: 9,156

[22] Filed: Feb. 2, 1979

[51] Int. Cl.[2] ..... A41D 13/06

[52] U.S. Cl. ..... 2/22; 128/80 C

[58] Field of Search ..... 2/22, 2 R, 24; 128/80 C, 165, 518 R, 538, 579

[56] References Cited

U.S. PATENT DOCUMENTS

| | | | |
|---|---|---|---|
| 3,587,572 | 6/1971 | Evans | 2/24 |
| 3,677,265 | 7/1972 | Brabazon | 2/24 |
| 4,089,064 | 5/1978 | Chandler | 2/2 |
| 4,144,592 | 3/1979 | Larson | 2/24 |

*Primary Examiner*—H. Hampton Hunter

*Attorney, Agent, or Firm*—Snider, Sterne & Saidman

[57] ABSTRACT

A device which is designed for use by athletes to protect against and prevent injury to the knees, lower extremities, ankles and feet, without restricting mobility or efficiency. The apparatus includes a dynamic system of components which are worn by the athlete during the athletic event and, in a preferred embodiment, includes elastic, corset-like tights or leggings which have secured thereto at least one pair of cable assemblies, one for each leg, which extend from the hip area to the foot area. Each cable assembly includes a flexible, non-elastic cable which is wrapped about the leg at least one full turn between the hip and the foot. Means are provided for securing the lower end of the cable to the athletic shoe of the wearer, and means are also provided for tensioning the cable to any desired degree. The tensioned cable assemblies protect the limb complex unit from angular and torsional stresses incurred during the athletic event.

16 Claims, 9 Drawing Figures

10
16
24
18
24'
30'
25
30
3
27
3
60
28
39
37
60
60
60
29
31
14
12
33
35
6
26'
26
44
46
20
22
6

40
38
42
24
16
39
30
28

30
36
36
28
32
34
16

5
66
64
5
62
64
68

16
66
72
70
64
16
62

28
30
7
56
58
26'
48
52
7
22

22
56
58
54
52
50
48
46

INJURY PROTECTION DEVICE FOR ATHLETES

BACKGROUND OF THE INVENTION

1. Field of the Invention

The present invention is related to injury preventing devices and, more particularly, is directed towards a device for preventing leg injuries to athletes during the playing of an athletic contest.

2. Description of the Prior Art

Very few injury preventing devices are worn by athletes during the playing of an athletic contest. During a particularly rugged contest, such as football, the legs of the athlete are subjected to severe angular and torsional stresses which can and have caused injuries to the knee, lower leg, ankle and foot.

The most common types of athletic braces in use today are not prophylactic in nature. That is, such braces, as the common elastic knee brace, are utilized primarily after a knee injury has occurred in order to provide additional support and thereby minimize strain on the knee. Clearly, if a device or apparatus could be provided which can be worn by an athlete during the playing of the athletic contest which would tend to prevent such injuries, and which would not interfere with the athlete's mobility of playing efficiency, it would be most welcomed, especially on the football field where an alarming increase in athletic injuries have been experienced.

I am aware of the following prior art U.S. patents which may be related to this general area: Nos. 1,308,675; 1,548,711; 2,871,852; 3,295,517; and 3,900,898. Most of the devices described in these patents are rigid, static devices, and would be ill-adapted for the uses contemplated by the present invention.

OBJECTS AND SUMMARY OF THE INVENTION

It is therefore a primary object of the present invention to provide a device for use by athletes which acts to prevent the occurrence of injuries to the knees, lower extremities, ankles and feet, without restricting mobility or efficiency.

Another object of the present invention is to provide an injury prevention device for athletes which is worn during the athletic event, without impairing performance of the athlete, but which protects the limb complex unit from angular and torsional stresses that frequently result in crippling or disabling injuries.

A still further object of the present invention is to provide a dynamic injury prevention device particularly for use by athletes during an athletic contest which, while reducing the occurrence of injuries, nevertheless permits the user to run, pivot, twist, stop quickly, bend, or the like, without difficulty.

A still further object of the present invention is to provide a dynamic apparatus which is designed to become part of standard athletic equipment to thereby provide a prophylactic injury preventing effect, to thereby greatly reduce athletic related injuries.

The foregoing and other objects are attained in accordance with one aspect of the present invention through the provision of apparatus for use in preventing athletic injury, which comprises cable means adapted to extend between the hip area and foot area of a user by being wrapped at least one full turn about the leg between the hip and foot. Means are further provided for securing the cable means at its first end in the hip area and at its second end in the foot area. Means may also be provided for adjusting the tension of the cable means, and leggings means may be worn by the user for supporting the cable means. The leggings means preferably comprises an elastic material, while the cable means may consist of a flexible, non-elastic cable such as steel.

In accordance with other aspects of the present invention, guide means are preferably attached to the leggings means for housing the cable means therein. The means for securing the cable at the second end may preferably comprise an L-shaped brace adapted to be placed under the foot of the user. The brace has means for adjusting the tension in the cable means formed on a vertical flange thereof. The second end of the cable means preferably includes a threaded portion while the tension adjusting means includes a guidepost through which the cable extends and a nut positioned about the threaded portion adjacent the post for adjusting the length of the cable.

In accordance with yet other aspects of the present invention, means are attached to the leggings means at the knee area thereof for further bracing and guiding the cable means therethrough. The bracing and guiding means may comprise an additional elastic patch secured to the leggings means so as to have an opening through which the cable means passes. The means for sercuring the first end of the cable means may be attached to the leggings means on the upper rear side portion thereof, and the guide means in one embodiment extends therefrom along the leggings means downwardly about the outer side portion across the front side portion to the inside knee portion, and then about the upper rear calf portion downwardly around the outer side mid-calf portion and across the front lower calf and ankle portion to be terminated at the inside arch of the foot of the user. Second guide means may also be provided for housing second cable means and are attached to the leggings means and extend between the upper front side portion thereof to the outside arch of the foot of the user in a fashion complimentary to the first guide means. Additionally, substantially identical structure may be provided for the other leg of the user.

In an alternate embodiment, the means for securing the first end of the cable means is attached to the leggings means on the middle rear side portion thereof, while the guide means extends therefrom along the leggings means downwardly about the rear thigh portion to the inside knee portion, and then across the front knee portion and around and down the rear calf portion to be terminated at the inside arch of the user.

BRIEF DESCRIPTION OF THE DRAWINGS

Various objects, features and attendant advantages of the present invention will be more fully appreciated as the same because better understood from the following detailed description of the present invention when considered in connection with the accompanying drawings, in which.

DETAILED DESCRIPTION OF THE PREFERRED EMBODIMENTS

Figure 1:
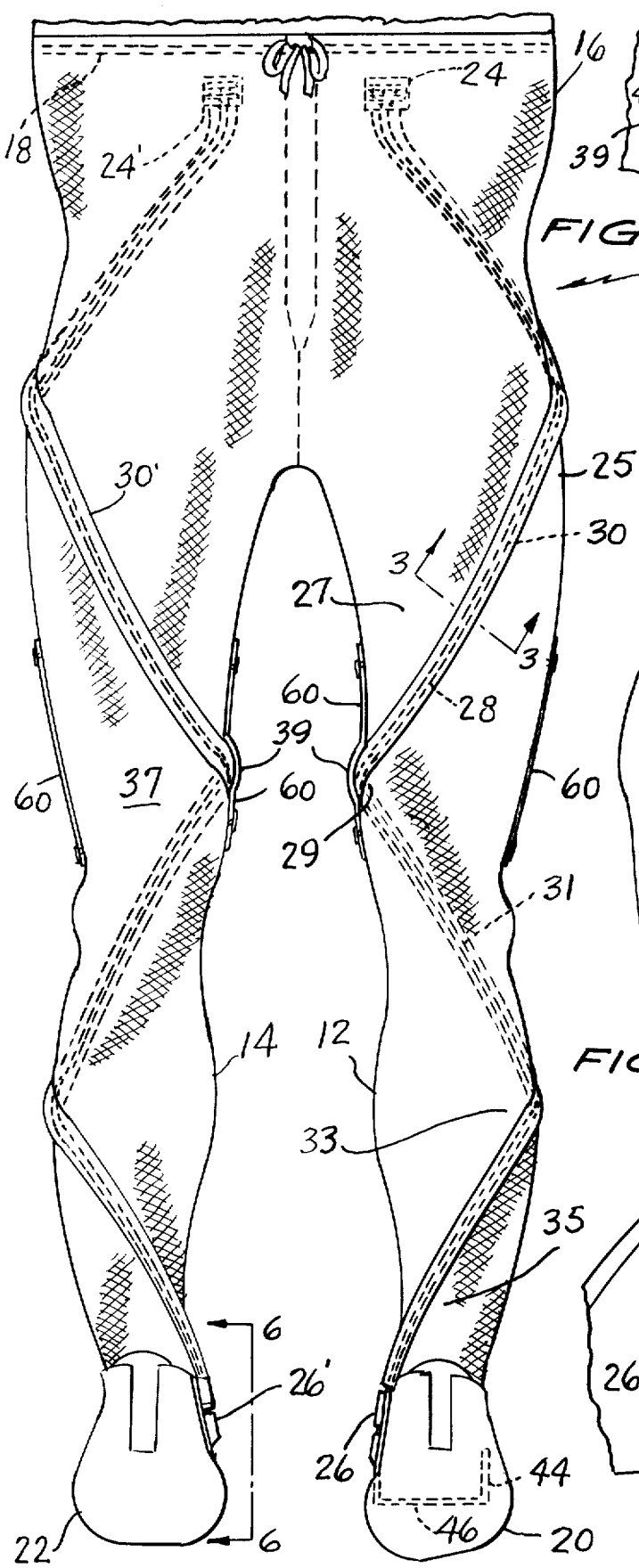
FIG. 1 is a plan view in elevation which illustrates a preferred embodiment of the present invention.

Referring now to the drawings, wherein like reference numerals represent identical or corresponding parts throughout the several views, and more particularly to FIG. 1 thereof, the injury prevention device for athletes is indicated generally by reference numeral 10. Device 10 is illustrated as would be worn on the legs of an athlete during or prior to the commencement of an athletic contest in order to minimize the possibility of knee, lower leg, ankle or foot injury, in a manner which will become more clear hereinafter.

The device 10 includes an elastic, corset-like pair of tights or leggings 16 having a waistband 18 and leg portions 12 and 15. The leggings 16 are tight-fitting, lightweight, and will not interfere with the athlete's normal ability to maneuver. Also illustrated in FIG. 1 are a pair of athletic shoes 20 and 22 which have been modified in a manner which will be described in greater detail hereinbelow.

Wrapped about each leg and extending from an upper anchoring device 24 located on the rear side portion of the leggings 16 to a lower anchoring device indicated generally by reference numeral 26 and located on the inside arch of each shoe 20 and 22 is a flexible, non-elastic cable 28, which is preferably made of steel. Other materials, either natural or synthetic, may be utilized.

Figure 3:
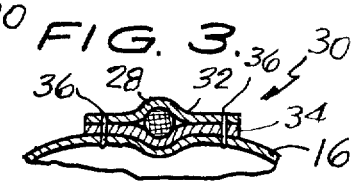
FIG. 3 is a cross-sectional view of certain components of the preferred embodiment illustrated in FIG. 1 and taken along line 3—3 thereof.

The cable 28 is preferably encased in a guide member 30 which, as illustrated in FIG. 3, is preferably formed of two layers 32 and 34 of elastic which may be pinned or stitched at 36 to the elastic leggings 16.

Figure 2:
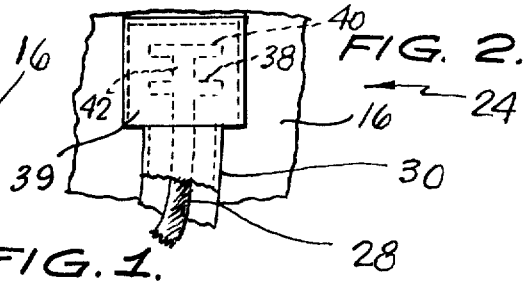
FIG. 2 is an enlarged fragmentary view of one portion of the preferred embodiment illustrated in FIG. 1.

FIG. 2 illustrates one possible construction of the upper anchoring device 24 in greater detail. the upper end 42 of the cable assembly 30 may be secured to the leggings 16 by means of transversely extending retaining pieces 38 and 40 which may be secured to the leggings 16 by stitched or otherwise secured retainer member 39.

Figure 6:
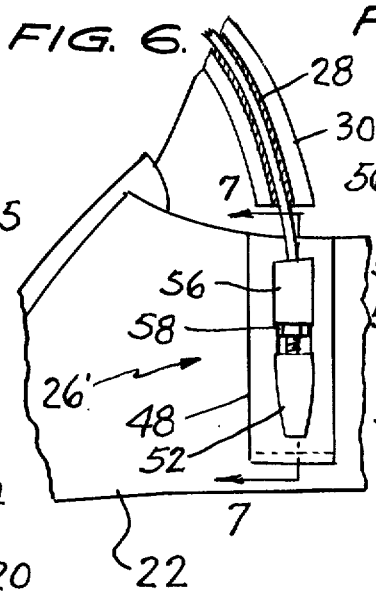
FIG. 6 is an enlarged, fragmentary side view of yet another component of the preferred embodiment illustrated in FIG. 1 and taken along line 6—6 thereof.
Figure 7:
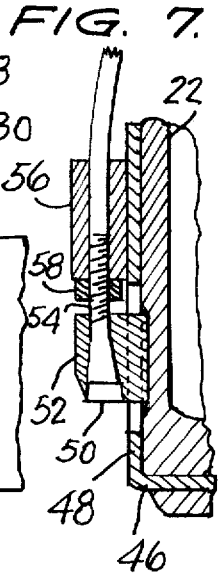
FIG. 7 is another enlarged, fragmentary, cross-sectional view of the component illustrated in FIG. 6 and taken along line 7—7 thereof.

Referring now to FIGS. 6 and 7, the lower anchoring device 26 is illustrated in greater detail. It may be appreciated from FIG. 1 that the normal athletic shoe 20 may be modified or supplemented by the addition thereto of a U- or L-shaped foot brace 44 having a lower plate 46 adapted to be positioned under the arch of the foot of a user. Extending perpendicularly upwardly from foot plate 46 is a flange 48 which is adapted to be mounted on the outside of the shoe 20. A guide tube 56 and retaining tube 52 are formed in an aligned relationship on the flange 48 and include longitudinal apertures therein for receiving the cable 28. More particularly, the lower end 50 of the cable 28 is enlarged and thereby secured to the brace 44 by means of a similarly shaped aperture in lower retaining tube 52. A portion of the cable 28 adjacent lower end 50 is threaded as at 54, and a tension-adjusting nut 58 is positioned adjacent the steel guide tube 56 for adjusting the tension in cable 28 throughout the assembly. Obviously, other equivalent anchoring means will suggest themselves to a person of ordinary skill in the art.

In the preferred embodiment illustrated in FIG. 1, a cable assembly 30 is provided for each leg and extends from the upper anchoring device 24 downwardly to the foot anchor 26 so as to encircle the leg at least one full turn. More particularly, in the illustrated embodiment, the guide means for the cable extends from the upper anchoring device 24 downwardly about the outer thigh portion 25 across the front thigh portion 27 to the inside knee portion 29 of the leggings 16. Then, the cable assembly 30 continues downwardly along the upper rear calf portion 31 around the outer side mid-calf portion 33 and across the front lower calf and ankle portion 35 to be terminated on the inside arch of the foot at anchor assembly 26.

When suitably tensioned, the cables 28 are made taut to thereby protect the limb complex unit from angular and torsional stresses during the severe motion and contacts encountered in athletic activities, thereby acting as an important prophylactic device.

Figure 4:
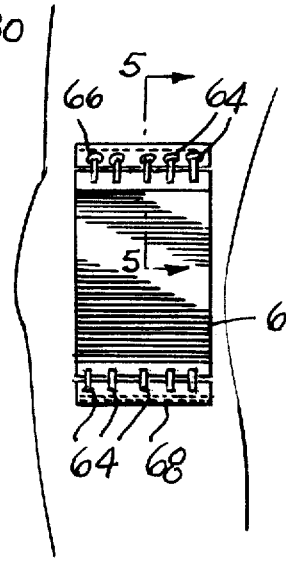
FIG. 4 is a side view of yet another component of the preferred embodiment illustrated in FIG. 1.
Figure 5:
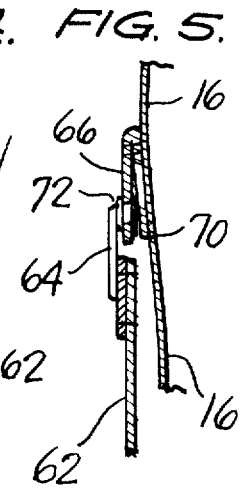
FIG. 5 is an enlarged, fragmentary, cross-sectional view of the component illustrated in FIG. 4 and taken along line 5—5 thereof.

Preferably formed on both sides of the knee portion 37 of leggings 16 are lateral braces and guide members which are indicated generally by reference numeral 60 in FIG. 1. As illustrated in greater detail in FIGS. 4 and 5, each brace 60 may comprise an elastic piece of material 62 which is coupled to a pair of retaining fabric pieces 66 and 68 that are, in turn, secured to the leggings 16 by, for example, sewing. Metal clips 64 with hooks 70 may be utilized to cooperate with eyelets 72 in pieces 66 and 68 for securing the elastic piece 62 in place. In this construction, an opening is provided on both the inside and outside knee portions through which the cable assembly 30 may extend, as indicated by reference numeral 39 in FIG. 1.

Figure 8:
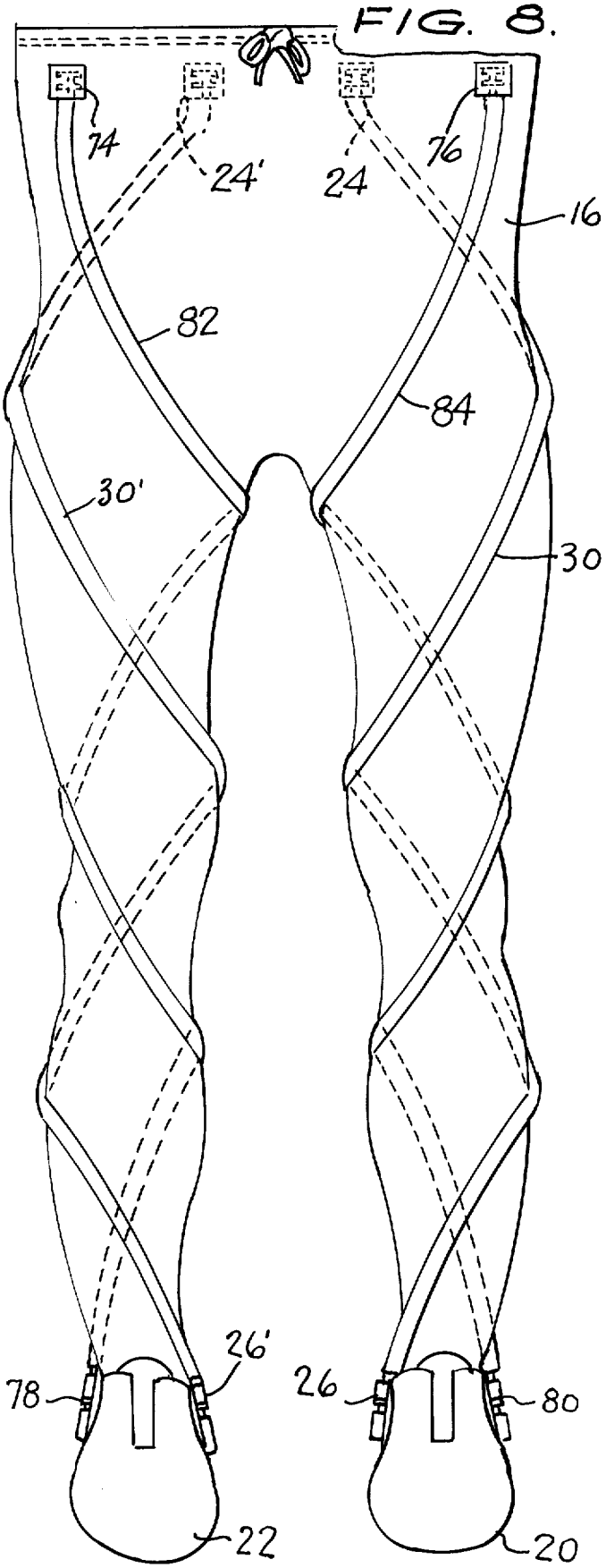
FIG. 8 is a plan view similar to FIG. 1 but illustrating an alternate embodiment of the present invention.

FIG. 8 illustrates an alternate embodiment of the present invention which basically includes two sets of cable assemblies for each leg. Each cable assembly is wound in a complimentary fashion to the other. More specifically, top front supports 74 and 76 are provided in addition to the top anchors 24 and 24' of the first embodiment. From the anchors 74 and 76 extend substantially identical cable assemblies 82 and 84 which are wound in the reverse fashion about the leg so that they terminate in respective lower anchoring devices 78 and 80, respectively. In FIG. 8, the knee braces 60 are not illustrated for the sake of simplicity, but they may be provided if desired. The lower anchoring devices 78 and 80 may be substantially identical to the anchor device 26 as described hereinabove.

Figure 9:
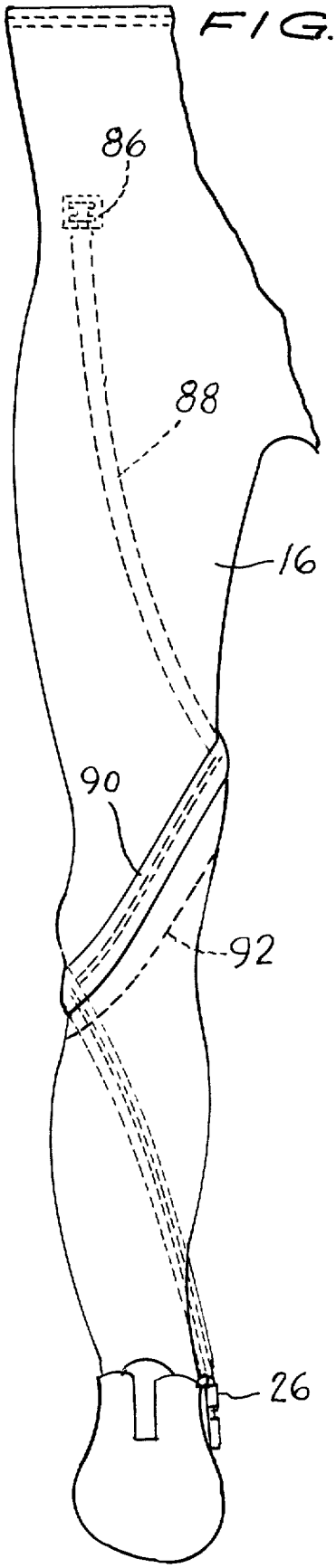
FIG. 9 is a fragmentary view similar to FIG. 8 but which illustrates yet another alternate embodiment of the present invention.

Referring now to FIG. 9, yet another alternate mode of winding a cable assembly about the leg is illustrated and is seen to include an upper anchoring device 86 positioned on the middle rear side portion of leggings 16. The guide means 88 for the cable therewithin extends from anchor 86 downwardly about the rear thigh portion to the inside knee portion, and then across the front knee portion and around and down the rear calf portion to be terminated at the inside arch of the user. A narrow angled sling 90 may be provided across the front of the knee to further assist in preventing inner knee stress. Sling 90 may be widened as indicated by dotted lines at 92 to further reduce inner knee stress, as may be required for a particular athlete.

Obviously, numerous modifications and variations of the present invention are possible in light of the above teachings. For example, the cables may be alternated, and utilized singly or doubly, depending upon the amount of stability desired for the knee-lower leg-ankle-foot complex. As pointed out above, when used singly, the cable may be routed either around the front or the back of the upper and lower legs, respectively, and may be attached to either the inner or outer part of the athletic shoe. The present invention is designed to be utilized by athletes prior to occurrence of injury, in order to prevent same. The complex limb units are prevented from being overstressed during motion or contact.

Therefore, it is to be understood that within the scope of the appended claims, the invention may be practiced otherwise than as specifically described herein.

I claim as my invention:

1. Apparatus for use in preventing athletic injury, which comprises cable means comprising a flexible nonelastic cable having first and second ends and adapted to extend between the hip area and foot area of a user by being wrapped at least one full turn about the leg beginning at said hip area and ending at said foor area, means for securing said cable at its first end in said hip area and at its second end in said foot area, and guide means extending about said leg for housing said cable.

2. The apparatus as set forth in claim 1, further comprising means for adjusting the tension of said cable means between the hip area and foot area.

3. The apparatus as set forth in claim 2, further comprising leggings means worn by the user for supporting said cable means.

4. The apparatus as set forth in claim 3, wherein said leggings means comprises an elastic material.

5. The apparatus as set forth in claim 3, wherein said cable comprises steel.

6. The apparatus as set forth in claim 3, wherein said guide means is attached to said leggings means for housing said cable means therein.

7. The apparatus as set forth in claim 1, wherein said means for securing said cable means at said second end comprises an L-shaped brace adapted to be placed under the foot of the user.

8. The apparatus as set forth in claim 7, wherein said brace has means for adjusting the tension in said cable means formed on a vertical flange thereof.

9. The apparatus as set forth in claim 8, wherein said second end of said cable means includes a threaded portion, and said tension adjusting means includes a guide post through which said cable extends and a nut positioned about said threaded portion adjacent said post for adjusting the length of said cable.

10. The apparatus as set forth in claim 3, further comprising means attached to said leggings means at the knee area thereof for further bracing and guiding of said cable means therethrough.

11. The apparatus as set forth in claim 10, wherein said bracing and guiding means comprises an additional elastic patch secured to said leggings means so as to have an opening through which said cable means passes.

12. The apparatus as set forth in claim 6, wherein said means for securing said first end of said cable means is attached to said leggings means on the upper rear side portion thereof, and said guide means extends therefrom along said leggings means downwardly about the outer thigh portion across the front thigh portion to the inside knee portion, and then about the upper rear calf portion downwardly around the outer side mid-calf portion and across the front lower calf and ankle portion to be terminated at the inside arch of the foot of the user.

13. The apparatus as set forth in claim 12, further comprising second guide means for housing second cable means and attached to said leggings means and extending between the upper front side portion thereof to the outside arch of the foot of the user in a fashion complementary to said first guide means.

14. The apparatus as set forth in claims 12 or 13, further comprising substantially identical guide means and cable means for the other leg of the user.

15. The apparatus as set forth in claim 6, wherein said means for securing said first end of said cable means is attached to said leggings means on the middle rear side portion thereof, and said guide means extends therefrom along said leggings means downwardly about the rear thigh portion to the inside knee portion, and then across the front knee portion and around and down the rear calf portion to be terminated at the inside arch of the user.

16. The apparatus as set forth in claim 15, further comprising substantially identical guide means and cable means for the other leg of the user.

* * * * *